US005478248A

United States Patent [19]

Mitra et al.

[11] Patent Number: 5,478,248

[45] Date of Patent: Dec. 26, 1995

[54] CONNECTOR FOR HIGH DENSITY ELECTRONIC ASSEMBLIES

[75] Inventors: Niranjan K. Mitra, Eindhoven, Netherlands; Yakov Belopolsky, Harrisburg, Pa.

[73] Assignee: Berg Technology, Inc., Reno, Nev.

[21] Appl. No.: 169,152

[22] Filed: Dec. 17, 1993

[51] Int. Cl.[6] ..... H01R 9/09

[52] U.S. Cl. ..... 439/74; 439/857

[58] Field of Search ..... 439/74, 83, 395, 439/856, 857, 47, 59, 65, 79, 80, 284

[56] References Cited

U.S. PATENT DOCUMENTS

| | | | |
|---|---|---|---|
| 3,199,066 | 8/1965 | Eledge et al. | 339/176 |
| 3,555,497 | 1/1971 | Watanabe | 439/857 |
| 3,596,235 | 7/1971 | Teurlings et al. | 339/217 R |
| 3,601,775 | 8/1971 | Longenecker et al. | 439/857 X |
| 3,864,004 | 2/1975 | Friend | 339/258 R |
| 4,183,611 | 1/1980 | Casciotti et al. | 339/275 B |
| 4,230,391 | 10/1980 | Keglewitsch | 439/395 |
| 4,628,410 | 12/1986 | Goodman et al. | 361/413 |
| 4,917,614 | 4/1990 | Kikuchi et al. | 539/83 |
| 4,934,945 | 6/1990 | Nakamura | 439/856 X |
| 4,969,829 | 11/1990 | Sato | 439/83 |
| 5,013,264 | 5/1991 | Toudreault | 439/636 |
| 5,037,316 | 8/1991 | Fukushina et al. | 439/83 |
| 5,078,611 | 1/1992 | Tanigawa et al. | 439/78 |
| 5,104,324 | 4/1992 | Grabbe et al. | 439/62 |
| 5,199,884 | 4/1993 | Kaufman et al. . | |
| 5,324,215 | 6/1994 | Walkup et al. | 439/857 |

*Primary Examiner*—David L. Pirlot
*Assistant Examiner*—Jill Demello
*Attorney, Agent, or Firm*—Woodcock Washburn Kurtz Mackiewicz & Norris

[57] ABSTRACT

An electrical connector includes a housing and a plurality of terminals secured within the housing for mounting a mating connector or an electronic module or the like having a plurality of electronic leads disposed thereon to a printed substrate. Each of the terminals has a connecting base portion that is mechanically connected to the printed substrate and a non-connecting base portion that is not mechanically connected to the printed substrate, but rather freely contacts the printed substrate. A first contact beam is cantilevered from the connecting base portion and has a distal end, while a second contact beam is similarly cantilevered from the non-connecting base portion and also has a distal end wherein a gap is formed between the distal ends of the contact beams. The leads of the mating connectors or the like are inserted into the gap for contacting engagement with the contact beams. The width of the contact beam cantilevered from the connecting base portion is preferably greater than the width of the contact beam cantilevered from the non-connecting base portion. A gap adjustment provides for simple adjustment of the size of the gap between the contact beams.

20 Claims, 2 Drawing Sheets

CONNECTOR FOR HIGH DENSITY ELECTRONIC ASSEMBLIES

FIELD OF THE INVENTION

This invention relates to a connector having a plurality of dual-beam terminals for connecting a mating connector or the like to a circuit board. More particularly, this invention relates to a connector having a plurality of asymmetric terminals wherein each terminal comprises two resilient contact beams having free distal ends which are separated by a gap for receiving a lead of a mating connector or the like.

BACKGROUND OF THE INVENTION

Miniature and portable electronic devices are among the fastest growing segments of the electronics industry. Among these devices are cellular phones operating with a ground cell network, satellite communication net terminals, laser and infrared measurement instruments, and work-stations including combinations of personal computers, facsimile machines with voice telecommunication terminals and notebook computers.

An important trend in the electronics industry has been the increasing utilization of integrated circuits as individual components due to their relatively inexpensive cost, miniature size, and electrical dependability. Today it is common for hundreds of complex integrated circuits to be treated as discrete components by the design engineer, with such integrated circuits being appropriately packaged and electrically connected to their associated printed circuit boards.

Many of the current electronic designs contain a variety of components such as, flexible, rigid, and semi-rigid printed circuit boards, hybrid circuits and large silicon integrated circuits. These components must be mounted together by electrical connectors having a plurality of terminal contacts which provide for inexpensive latching and containment of the electronic components. The known mounting techniques, such as surface mounting technology, plated through hole mounting, or a combination thereof, are used for mounting a multichip electronic module, or a mating connector or the like to a circuit board. However, known connector terminals which are small enough to satisfy the dense packaging requirements and have the desired strength suitable for withstanding the vibrations and shocks which are common to these applications have not provided a reliable latching mechanism for the electronic modules or mating connectors since the small, densely packed terminals are prone to breaking.

A trend in the industry has been toward taller connectors having dual beam type connector terminals commonly referred to as tuning-fork connectors. However, the height of these connector terminals is relatively large to provide that the terminals can withstand the associated mounting forces. Thus, these types of connectors are undesirable where the packaging design necessitates a low-profile connector.

Therefore, there is a need for a low cost, low profile, high density connector having a plurality of terminal contacts which can be easily manufactured, allows for simple and effective regulation of insertion forces and has the strength necessary for providing a reliable connection between an electronic module or the like and a printed circuit board. The present invention provides an electrical connector which satisfies this need.

SUMMARY OF THE INVENTION

Accordingly, it is an object of the invention to provide an improved connector for a high-density electronic module, mating connector or the like that is inexpensive and simple in construction.

An electrical connector in accordance with the present invention comprises a housing and a plurality of terminals secured in the housing for connecting a mating connector or the like to a printed substrate. Each of the terminals has a connecting and a non-connecting base portion, the connecting base portion for mechanical connection with the printed substrate. The connecting portion has a first contact beam cantilevered therefrom, with the first contact beam having a first distal end. Similarly, the non-connecting portion has a second contact beam cantilevered therefrom, with the second contact beam having a second distal end, and wherein a gap is formed between the first and second distal ends. The first and second contact beams are for receiving an electrical lead inserted in the gap such that the electrical lead contacts at least one of the distal ends for establishing electrical connection between the lead and the printed substrate and for providing reliable mounting of the mating connector on the printed substrate.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
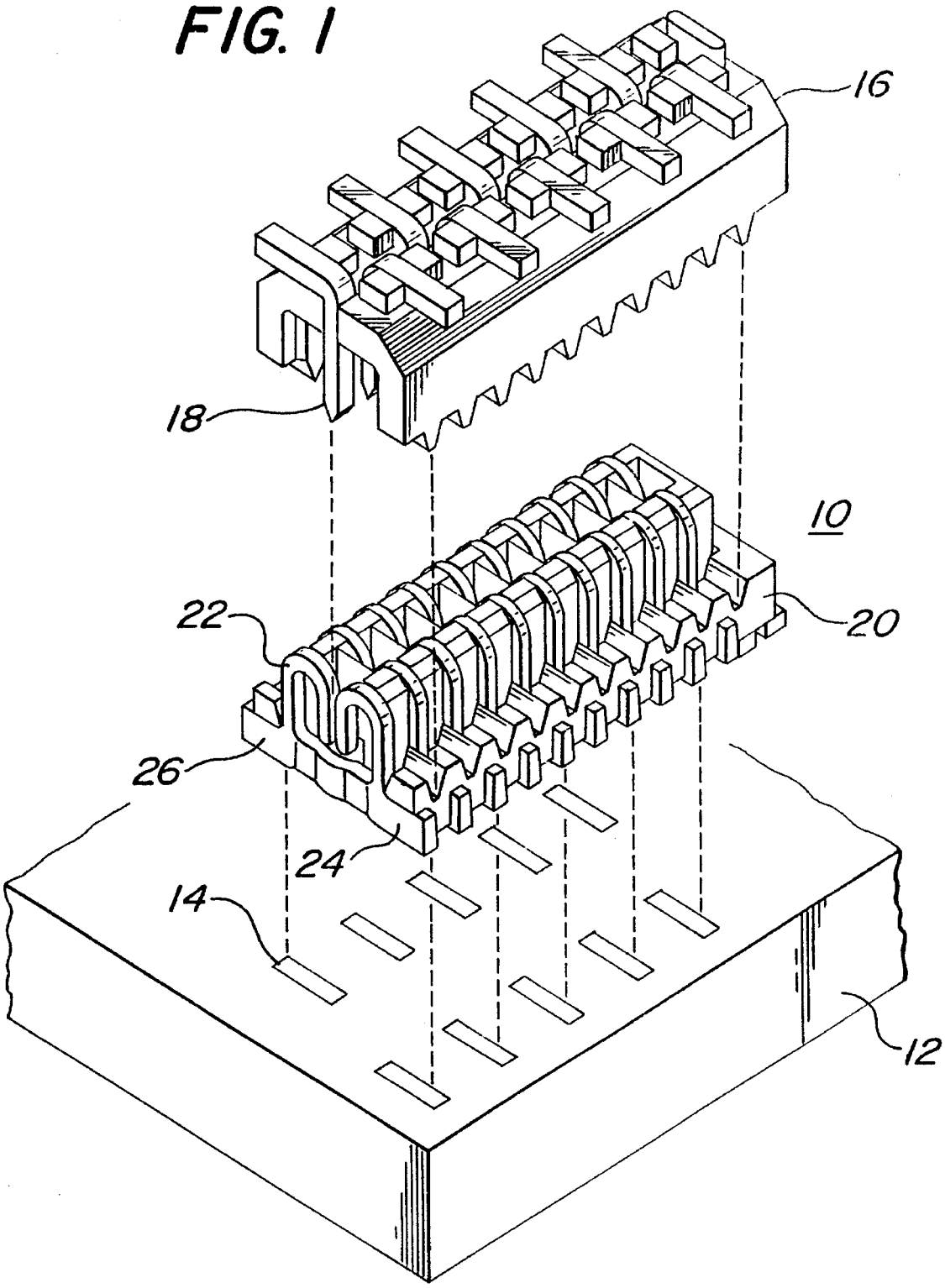
FIG. 1 is an exploded perspective view of a universal connector in accordance with the present invention.

Referring now to the drawings, wherein like reference numerals designate corresponding structure throughout the views, and referring in particular to FIG. 1, an improved connector 10 is constructed and arranged to be attached to a motherboard or substrate 12 that has contacts 14, preferably comprising copper, thereon. Contacts 14 can be pads of solder disposed on substrate 12 in a known manner or plated through holes. Substrate 12 can be a printed circuit board or the like having electronic circuitry printed thereon for carrying out specific functions in a known manner.

Connector 10 is adapted to receive an electronic male connector 16 that is of the type that has a plurality of leads 18 positioned on an underside thereof. Leads 18 can be, for example, contact pins that are bent downwardly orthogonally to the plane of the male connector 16 as shown in FIG. 1. However, the present invention is not intended to be limited in this manner and connector 10 can be adapted to receive a variety of electronic modules or the like, as set forth in further detail below, such as a thin card-type electronic module having a plurality of flat contact pad leads positioned on an underside thereof and adjacent to one or more edges of the electronic module.

Figure 2:
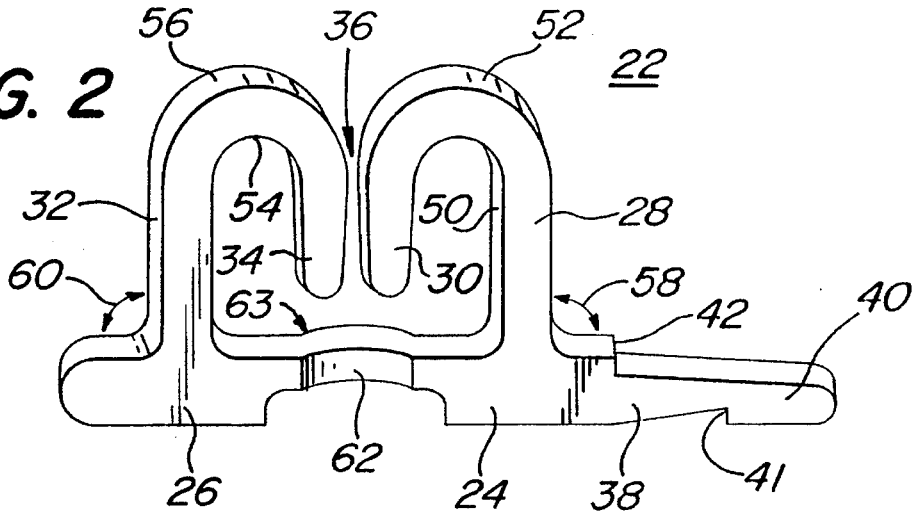
FIG. 2 is a perspective view of one embodiment of a connector terminal in accordance with the present invention.
Figure 3:
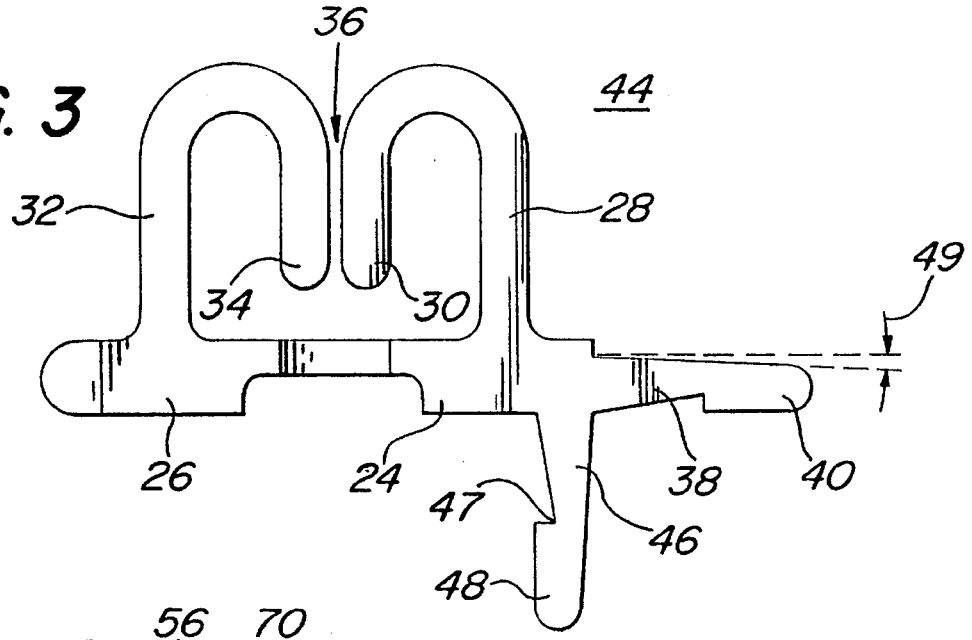
FIG. 3 shows another embodiment of a connector terminal in accordance with the present invention.
Figure 4:
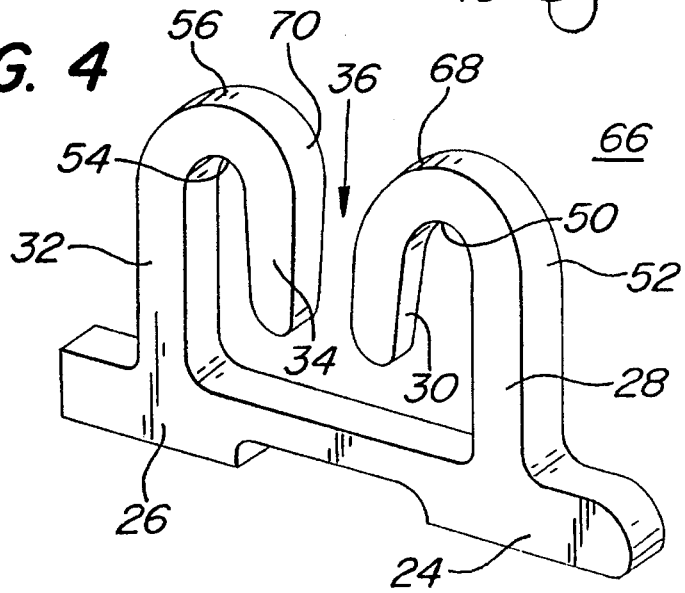
FIG. 4 shows a further embodiment of a connector terminal in accordance with the present invention.

Connector 10 includes a housing 20 preferably fabricated from a non-conductive, non-metallic material, such as hard plastic. A plurality of connector terminals 22 are positioned in and securely mounted in housing 20. Terminals 22 preferably comprise a material having a high electrical conductivity and high elastic modulus, such as phosphorous bronze or beryllium bronze, and can be formed by any known manufacturing method, such as stamping or etching. As shown in FIGS. 2–4, terminals can be selected from a variety of embodiments depending upon the particular application and design constraints of the user and the purpose, construction and operation of the various types of terminals 22, 44, 66 are discussed at length and in greater detail below.

As shown in FIG. 2, a terminal 22 includes a connecting base portion 24 and a non-connecting base portion 26. A resilient first contact beam 28 is cantilevered from connecting base portion 24 and has a distal end 30. Similarly, a resilient second contact beam 32 is cantilevered from non-connecting base portion 26 and has a distal end 34. The longitudinal plane of the terminal is herein defined as that plane in which the contact beams are cantilevered from their respective base portions. A gap 36 is formed between the distal ends 30, 34 of the contact beams 28, 32 and the contact beams receive lead 18 inserted in the gap 36, as shown in FIG. 1, such that the electrical lead 18 contacts at least one of the distal ends 30, 34 for establishing electrical connection between the lead and the printed substrate 12. As discussed above, where a particular application requires that connector 10 is connected to an edge card type connector having a plurality of leads on one of the sides thereof, the edge of the card is disposed in the gaps of the adjacent terminals such that the leads contact the distal end of one of the contact beams of the connector terminal.

Referring to FIGS. 1 and 2, connecting base portion 24 is mechanically connected to one of the contacts 14 on substrate 12 in the manner described in detail below, while non-connecting base portion 26 is disposed in free contacting engagement with substrate 12. Thus, only one side of the connector terminal is mechanically connected to the printed substrate and restrained thereby. The asymmetric nature of the mechanical connection of the connector terminals to the printed substrate provides a connector terminal which reliably secures the leads of the mating connector and which can withstand the stresses and vibrations of the connector environment without breaking.

Referring to FIG. 1, in one embodiment of the present invention terminals 22 are alternatingly arranged in housing 20 and contacts 14 are alternatingly arranged on substrate 12 such that, when considering adjacent terminals, the connecting base portion 24 of one terminal is mechanically connected to contact 14 such that it is disposed at the opposite end of the connecting base portion of the adjacent terminal.

In the embodiment shown in FIG. 2, connecting base portion 24 includes plated through hole attachment 38 and attachment tail 40. As shown in FIG. 1, terminal 22 can be used as a surface mount type wherein connecting base portion 24, including attachment 38 and attachment tail 40, is solderably connected to a solder pad contact 14 in a known manner. In those applications where a relatively smaller solder pad contact is used, attachment tail 40 can be removed from the terminal at indentation 41 by any known manner such that the connecting base portion 24, including only attachment 38, is soldered to the smaller solder pad contact.

In applications where contact 14 comprises a plated through hole, attachment 38 and attachment tail 40 of connecting base portion 24 are inserted in the plated through hole and soldered therein in a known manner so as to mechanically connect the connecting base portion 24 to the printed substrate. Right angle stop 42 provides a surface for contacting the printed substrate such that the terminal is mounted perpendicular to the printed substrate. In those applications where a relatively thinner printed substrate is used, attachment tail 40 can be removed from the terminal at indentation 41 such that the plated through hole attachment 38 is inserted in the hole.

Universal terminal 44 is shown in FIG. 3. Universal terminal 44 is similar in all aspects to and incorporates all of the features of terminal 22 shown in FIG. 2. The connecting base portion 24 of universal terminal 44 further includes universal plated through hole attachment 46 and universal tail 48 to provide further methods of mechanically attaching the connecting side of the terminal to a printed substrate. Attachment 38 and attachment tail 40 can be joined to the terminal at an insertion angle 49 where it is desirable to mount the terminal at an predetermined angle in relation to the printed substrate.

Universal terminal 44 can be used in a variety of applications. For example, universal attachment 46 and tail 48 can be inserted in a plated through hole provided in a printed substrate, while attachment 38 and attachment tail 40 can be solderably connected to a solder pad contact on the printed substrate for mechanically connecting the connecting base portion 24 to the printed substrate. In this embodiment, universal attachment 46 and tail 48 provide for reliable alignment of adjacent terminals on a printed circuit board or the like. In another example, where it is not desirable to surface mount the connector terminals to the printed substrate, attachment 38 and tail 40 can be removed from the terminal in a known manner such that universal attachment 46, including the tail 48, or with the tail removed at indentation 47 in the case of thin printed substrates, is connected to plated through holes in the substrate in a known manner. Many other methods of attachment to a printed substrate become readily available to the designer based upon combinations of the attachment features, with or without the tails, and based upon the use of surface mount and plated through hole techniques.

In a preferred embodiment of the present invention, the contact beam which is cantilevered from the connecting base portion of the connector terminals is wider than the contact beam which is cantilevered from the non-connecting base portion. Thus, referring once again to FIG. 2, the distance between the inner surface 50 and the outer surface 52 of contact beam 28, referred to herein as the width of the contact beam, is greater than the distance between the inner surface 54 and the outer surface 56 of contact beam 32. This difference in the width of the contact beams provides a further degree of asymmetry to the connector terminal and provides a more reliable mounting connection for the mating connector or the like. In particular, when a lead, such as a pin 18 of the mating connector 16 shown in FIG. 1, is inserted in the gap 36 of terminal 22 and makes contact with the contact beams 28, 32, the wider contact beam 28 will deflect less than contact beam 32 and the reaction forces on the pin cause the pin to rotate into a secure locking engagement between the contact beams. Preferably, the difference between the width of the terminals can vary up to a factor of two such that the width of the connecting base portion contact beam is twice as large as the width of the non-connecting base portion contact beam.

In a preferred embodiment, the inner surfaces 50, 54 and the outer surfaces 52, 56 of the contact beams comprise a circular curved surface in an area between the point at which the contact beams are cantilevered from the connecting and non-connecting base portions and the distal ends of the contact beams. The curved nature of the opening at the entry to the gap provides a wide throat for receiving an electrical lead, such as a mating pin or the like. Thus, a large level of tolerance is provided to ensure proper insertion of a male mating connector into the connector terminals and blind-mating of closely spaced printed circuit boards is simplified.

The stresses on the contact beams 28, 32 are also affected by the cantilever angles 58, 60 between the base portions 24, 26 and the outer surfaces of the contact beams 52, 56 at the area where the contact beams are cantilevered from the base portions. The ratio of the cantilever angle 60 of contact beam 32 to the cantilever angle 58 of contact beam 28 can range from 0.5 to 2. In a preferred embodiment, both of these cantilever angles 58, 60 are about 90 degrees.

In order to plate and stamp a miniature terminal connector having

In a preferred embodiment, a gap adjustment 62 is disposed between and integrally joins connecting base portion 24 and non-connecting base portion 26 and can be adjusted to provide a desired size for the gap 36 between the distal ends of the contact beams. In the embodiment shown in FIG. 2, gap adjustment 62 has a curved profile which projects a predetermined depth, defined as the distance from the terminal centerline to the centerline of the gap adjustment, outside of the longitudinal plane of the terminal. This profile and depth correspond to a particular gap size.

In order to adjust the gap size, the depth or the profile, or both, of the gap adjustment 62 is altered to obtain the desired gap size. The gap adjustment can be altered by displacing the gap adjustment material to change the depth at which the gap adjustment extends outside of the longitudinal plane of the terminal and/or by displacing the gap adjustment material to change the profile of the gap adjustment while maintaining a specified depth. The depth of the gap adjustment can vary from zero, i.e. no adjustment, to one-half of the pitch distance between the centerline of adjacent terminals. It is preferable to form the shape of the gap adjustment for a desired gap size such that the contact beams and the base portions remain aligned in parallel in the longitudinal plane of the terminal.

Thus, a terminal in accordance with the present invention can be manufactured by stamping and plating the terminal material with a gap size that is wider than the desired gap size and then the gap adjustment can be formed to adjust the gap to the desired size. Accordingly, the present invention obviates the known problems associated with the complex and fragile tooling which has heretofore been required for the stamping and plating of dual beam terminals having extremely small gap sizes.

Insulation displacement connector terminal 66, which is suitable for insulation displacement applications, is shown in FIG. 4. Connector terminal 66 can incorporate any of the features of terminals 22 and 44 shown in FIGS. 2 and 3 and can be adapted for the various mounting applications discussed above. Additionally, a portion of one, or both, of the contact beams 28, 32 is removed in the area of the gap 36 such that a sharp surface 68, 70 is created on the outer surfaces 52, 56 of the contact beams in the area of the gap 36. In this embodiment, an insulation cover, such as plastic, surrounding a wire lead conductor or the like that is inserted into the gap 36 is removed therefrom in a known manner and the wire lead disposed within the insulation cover makes contact with the distal ends 30, 34 of the contact beams. Preferably for this terminal embodiment, the gap 36 is less than 1 mm (0.04") and the depth of the gap adjustment, if any, is less than 0.25 mm (0.01"). Preferably, the inner and outer surfaces, 50, 54 and 52, 56 respectively, of the contact beams comprise a circular curved surface in an area between the point at which the contact beams are cantilevered from the base portions and the distal ends of the contact beams. In such an embodiment, when the radius of the circular curved inner surface 50, 54, referred to herein as $R_i$, is in the range of 0.2 mm (0.0079") to 20 mm (0.79"), the radius of the circular curved outer surface 52, 56, referred to herein as $R_o$, can be equal to or greater than the value arrived at using the following formula:

$$R_i+2(t)$$

where t is the thickness of the terminal material.

An insulation displacement connector terminal can be used for mounting a single electrical conductor wire or a plurality of conductors. Also, an insulation displacement connector terminal can be used for mounting cables which comprise a layer of insulation and a metal conductor wrapped around a plurality of conductors disposed within the cable. The cable is inserted into the gap 36 such that the sharp surfaces 68, 70 cut through the layer of insulation and the contact beams make contact with the metal layer in a known manner.

A connector in accordance with the present invention provides low cost, low-profile connector terminals which can be densely packed together and which provide a reliable latching mechanism for securing a mating connector or the like into electrical connection with a printed substrate. The connector terminals provide for a wide variety of mounting applications and can be simply modified to receive variable size leads of a mating connector or the like.

Although particular embodiments of the present invention have been described and illustrated herein, it is recognized that modifications and variations may readily occur to those skilled in the art. Consequently, it is intended that the claims be intended to cover such modifications and equivalents.

What is claimed is:

1. An electrical connector, comprising:

a housing;

a plurality of terminals secured in said housing, each of said terminals having:

a connecting and a non-connecting base portion, said connecting base portion for mechanical connection with a printed substrate, said connecting base portion having a first contact beam cantilevered therefrom, said first contact beam having a first distal end, said non-connecting base portion having a second contact beam cantilevered therefrom, said second contact beam having a second distal end, wherein a gap is formed between said first and second distal ends, said first and second contact beams for receiving an electrical lead inserted in said gap such that the electrical lead contacts at least one of said distal ends for establishing electrical connection between the lead and the printed substrate, said first contact beam having a first width, said second contact beam having a second width, the width of said first contact beam greater than the width of said second contact beam; and joining means for integrally joining said connecting and non-connecting base portions.

2. An electrical connector according to claim 1, wherein said connecting base portion includes a plated through hole attachment and an attachment tail integrally connected to said plated through hole attachment.

3. An electrical connector according to claim 2, wherein said connecting base portion further includes a universal plated through hole attachment and a universal tail integrally connected to said universal plated through hole attachment.

4. An electrical connector according to claim 3, wherein said universal plated through hole attachment and said universal tail are substantially perpendicular to said plated through hole attachment and said attachment tail.

5. An electrical connector according to claim 1, said first contact beam having a first inner surface and a first outer surface, said second contact beam having a second inner surface and a second outer surface, wherein said first inner and outer surfaces comprise a circular curved surface at an area between said connecting base portion and said first distal end, and said second inner and outer surfaces comprise a circular curved surface at an area between said non-connecting base portion and said second distal end.

6. An electrical connector according to claim 5, wherein the angle between said first outer surface and said connecting base portion is about 90 degrees, and the angle between said second outer surface and said non-connecting base portion is about 90 degrees.

7. An electrical connector, comprising:

a housing;

a plurality of terminals secured in said housing, each of said terminals having:

a connecting and a non-connecting base portion, said connecting base portion for mechanical connection with a printed substrate, said connecting base portion having a first contact beam cantilevered therefrom, said first contact beam having a first distal end, said non-connecting base portion having a second contact beam cantilevered therefrom, said second contact beam having a second distal end, wherein a gap is formed between said first and second distal ends, said first and second contact beams for receiving an electrical lead inserted in said gap such that the electrical lead contacts at least one of said distal ends for establishing electrical connection between the lead and the printed substrate; and joining means for integrally joining said connecting and non-connecting base portions, said joining means comprising a gap adjustment for changing the size of said gap.

8. An electrical connector according to claim 7, each said terminal having a longitudinal plane, wherein said gap adjustment has a curved profile projecting outside of said longitudinal plane.

9. An electrical connector according to claim 7, wherein said connecting base portion includes a plated through hole attachment and an attachment tail integrally connected to said plated through hole attachment.

10. An electrical connector according to claim 7, said first contact beam having a first inner surface and a first outer surface, said second contact beam having a second inner surface and a second outer surface, wherein said first inner and outer surfaces comprise a circular curved surface at an area between said connecting base portion and said first distal end, and said second inner and outer surfaces comprise a circular curved surface at an area between said non-connecting base portion and said second distal end.

11. An electrical connector, comprising:

a housing;

a plurality of terminals secured in said housing, each of said terminals having:

a connecting and a non-connecting base portion, said connecting base portion for mechanical connection with a printed substrate, said connecting base portion having a first contact beam cantilevered therefrom, said first contact beam having a first distal end, said non-connecting base portion having a second contact beam cantilevered therefrom, said second contact beam having a second distal end, wherein a gap is formed between said first and second distal ends, said first and second contact beams for receiving an electrical lead inserted in said gap such that the electrical lead contacts at least one of said distal ends for establishing electrical connection between the lead and the printed substrate, said first contact beam having a first outer surface, wherein said first outer surface is sharp in the area of said gap such that an insulation cover on a lead is removed therefrom upon insertion of the lead in said gap; and joining means for integrally joining said connecting and non-connecting base portions.

12. An electrical circuit assembly, comprising:

a printed substrate having a plurality of contact surfaces disposed thereon;

a first connector having a plurality of leads disposed thereon;

a second connector for electrically interconnecting said first connector and said printed substrate, said second connector comprising:

a housing;

a plurality of terminals secured in said housing, each of said terminals having:

a connecting and a non-connecting base portion, said connecting base portion mechanically connected to one of said contact surfaces, said non-connecting base portion freely contacting said printed substrate, said connecting base portion having a first contact beam cantilevered therefrom, said first contact beam having a first distal end, said non-connecting base portion having a second contact beam cantilevered therefrom, said second contact beam having a second distal end, wherein a gap is formed between said first and second distal ends, one of said leads inserted in said gap such that said lead contacts at least one of said distal ends for establishing electrical connection between said lead and said printed substrate, said first contact beam having a first width, said second contact beam having a second width, and said first width greater than said second width; and joining means for integrally joining said connecting and non-connecting base portions.

13. An electrical connector, comprising:

a housing;

a plurality of terminals secured in said housing, each of said terminals having:

a first and second base portion, said first base portion having a first contact beam cantilevered therefrom, said first contact beam having a first distal end, said second base portion having a second contact beam cantilevered therefrom, said second contact beam having a second distal end, said first contact beam having a first width, said second contact beam having a second width, said first width greater than said second width, wherein a gap is formed between said first and second distal ends, said first and second contact beams for receiving an electrical lead inserted in said gap; and joining means for integrally joining said first and second base portions.

14. An electrical connector according to claim 13, wherein said joining means comprises a gap adjustment for changing the size of said gap.

15. An electrical connector according to claim 13, said first contact beam having a first inner surface and a first outer surface, said second contact beam having a second inner surface and a second outer surface, wherein said first inner and outer surfaces comprise a circular curved surface at an area between said first base portion and said first distal end, and said second inner and outer surfaces comprise a circular curved surface at an area between said second base portion and said second distal end.

16. A connector terminal, comprising:

a connecting and a non-connecting base portion, said connecting base portion for mechanical connection with a printed substrate, said connecting base portion having a first contact beam cantilevered therefrom, said first contact beam having a first distal end, said non-connecting base portion having a second contact beam cantilevered therefrom, said second contact beam having a second distal end, wherein a gap is formed between said first and second distal ends, said first and second contact beams for receiving an electrical lead inserted in said gap such that the electrical lead contacts at least one of said distal ends for establishing electrical connection between the lead and the printed substrate, said first contact beam having a first width, said second contact beam having a second width, the width of said first contact beam greater than the width of said second contact beam; and joining means for integrally joining said connecting and non-connecting base portions.

17. A connector terminal according to claim 16, said first contact beam having a first inner surface and a first outer surface, said second contact beam having a second inner surface and a second outer surface, wherein said first inner and outer surfaces comprise a circular curved surface at an area between said connecting base portion and said first distal end, and said second inner and outer surfaces comprise a circular curved surface at an area between said non-connecting base portion and said second distal end.

18. A connector terminal according to claim 16, wherein said joining means comprises a gap adjustment for changing the size of said gap.

19. A connector terminal according to claim 18, each said terminal having a longitudinal plane, wherein said gap adjustment has a curved profile projecting outside of said longitudinal plane.

20. A connector terminal, comprising:

a connecting and a non-connecting base portion, said connecting base portion for mechanical connection with a printed substrate, said connecting base portion having a first contact beam cantilevered therefrom, said first contact beam having a first distal end, said non-connecting base portion having a second contact beam cantilevered therefrom, said second contact beam having a second distal end, wherein a gap is formed between said first and second distal ends, said first and second contact beams for receiving an electrical lead inserted in said gap such that the electrical lead contacts at least one of said distal ends for establishing electrical connection between the lead and the printed substrate, said first contact beam having a first outer surface, wherein said first outer surface is sharp in the area of said gap such that an insulation cover on a lead is removed therefrom upon insertion of the lead in said gap; and joining means for integrally joining said connecting and non-connecting base portions.

* * * * *